US007884589B2

(12) United States Patent
Lin

(10) Patent No.: US 7,884,589 B2
(45) Date of Patent: Feb. 8, 2011

(54) CONTROLLABLE POWER SUPPLY DEVICE WITH STEP-UP FUNCTION

(75) Inventor: Yung-Lun Lin, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 473 days.

(21) Appl. No.: 12/102,008

(22) Filed: Apr. 13, 2008

(65) Prior Publication Data

US 2008/0252146 A1 Oct. 16, 2008

(30) Foreign Application Priority Data

Apr. 12, 2007 (TW) ..... 96112824 A

(51) Int. Cl.
*G05F 1/56* (2006.01)

(52) U.S. Cl. ..... 323/281

(58) Field of Classification Search ..... 323/266, 323/280, 281, 349
See application file for complete search history.

(56) References Cited

U.S. PATENT DOCUMENTS 6,850,044 B2 * 2/2005 Hansen et al. ..... 323/266
7,068,019 B1 * 6/2006 Chiu ..... 323/281
2002/0167299 A1 * 11/2002 Curtin ..... 323/266
2004/0178776 A1 * 9/2004 Hansen et al. ..... 323/266
2006/0108992 A1 * 5/2006 Pruvost et al. ..... 323/281

* cited by examiner

*Primary Examiner*—Jeffrey L Sterrett
(74) *Attorney, Agent, or Firm*—Jianq Chyun IP Office

(57) ABSTRACT

A controllable power supply device with a step-up function including a constant voltage generator, a programmable voltage generator, a first switch and a linear regulator is provided. The constant voltage generator is used to provide an initial voltage. The programmable voltage generator is used to receive the initial voltage and adjust the received initial voltage to boost the initial voltage to a power supply voltage. The first connecting terminal of the first switch is used to receive the initial voltage, the second connecting terminal of the first switch is used to receive the power supply voltage, and the third connecting terminal of the first switch is coupled to one of the first connecting terminal and the second connecting terminal. Therefore, the voltage from the third connecting terminal of the first switch is stabilized and is outputted as the output voltage of the controllable power supply device by the linear regulator.

9 Claims, 4 Drawing Sheets

300A

| step-up order | SW1 | SW2 | SW3 | SW4 | power supply voltage |
|---|---|---|---|---|---|
| 1 | OFF | OFF | OFF | OFF | V1 |
| 2 | ON | OFF | OFF | OFF | V2 |
| 3 | OFF | ON | OFF | OFF | V3 |
| 4 | ON | ON | OFF | OFF | V4 |
| 5 | OFF | OFF | ON | OFF | V5 |
| 6 | ON | OFF | ON | OFF | V6 |
| 7 | OFF | ON | ON | OFF | V7 |
| 8 | ON | ON | ON | OFF | V8 |
| 9 | OFF | OFF | OFF | ON | V9 |
| 10 | ON | OFF | OFF | ON | V10 |
| 11 | OFF | ON | OFF | ON | V11 |
| 12 | ON | ON | OFF | ON | V12 |
| 13 | OFF | OFF | ON | ON | V13 |
| 14 | ON | OFF | ON | ON | V14 |
| 15 | OFF | ON | ON | ON | V15 |
| 16 | ON | ON | ON | ON | V16 |

CONTROLLABLE POWER SUPPLY DEVICE WITH STEP-UP FUNCTION

CROSS-REFERENCE TO RELATED APPLICATION

This application claims the priority benefit of Taiwan application serial no. 96112824, filed on Apr. 12, 2007. The entirety of the above-mentioned patent application is hereby incorporated by reference herein and made a part of this specification.

BACKGROUND OF THE INVENTION

1. Field of the Invention

The invention relates to a power supply device and, more particularly, to a controllable power supply device with a step-up function.

2. Description of the Related Art

Since the present science and technology has made enormous progress, the market have continuously weeded through the old to bring forth the new for electronic devices, and then the requirement that a power supply device has to have a plurality of groups of different voltage levels is more and more universal, and the requirement of the accuracy of each group of the voltage level provided by the power supply device becomes stricter and stricter. For example, the present market has several tens kinds of central processing units (CPU) applied to personal computers. Taking the same manufacture company as an example, operation voltages of the manufactured several kinds of CPUs are not the same, or taking the same type of the CPUs as an example, when a user wants to boost the voltage for some purpose, the power supply device has to provide a plurality of groups of power supply voltages to satisfy the requirement of the user.

FIG. 1 is a structural diagram showing a conventional step-up circuit 100. In FIG. 1, the conventional step-up circuit includes a linear regulator 120, resistances R11~R16 and switches SW1~SW4. The linear regulator 120 further includes an operation amplifier 121, N-type transistor T21, resistances R21~R22 and a capacitor C21.

Please refer to FIG. 1, and the resistances R15 and R16 are serially connected between a voltage VS11 and a grounding terminal to generate an initial voltage VI. The output terminal of the operation amplifier 121 is coupled to the negative input terminal of the operation amplifier 121 via the capacitor C21 to form a buffer circuit. The resistances R11~R14 can form parallel connection combinations in different coupling modes by switching the switches SW1~SW4, and form a current path to the ground with the resistances R21~R22, the transistor T21 and the voltage VS12. Herein, the resistance values of the resistances R21~R22 are diverse from each other, and then the conventional step-up circuit 100 utilizes the parallel connection combination formed by the resistances R21~R22 and the resistance voltage division principle to generate a plurality of groups of power supply voltages to achieve the step-up objective.

FIG. 2A is a schematic diagram showing the step-up table of the power supply voltage of the conventional step-up circuit 100. As shown in FIG. 2A, the resistances R11~R14 have sixteen types of parallel connection combinations via the on or off statuses of the switches SW1~SW4, in other words, when the step-up circuit 100 works under different step-up orders, the output voltage VO will be boosted to different power supply voltages. For example, if the step-up order is one, the conventional step-up circuit 100 enables the output voltage VO to be boosted to the power supply voltage V1 via the on status of the switch SW1. Similarly, when the step-up order is sixteen, the conventional step-up circuit 100 enables the output voltage VO to be boosted to the power supply voltage V16 via making the switches SW1~SW4 be on. The magnitude relation among the power supply voltages is that V1<V2<V3 . . . <V16, and then if the step-up order of the conventional step-up circuit 100 is higher, the step-up magnitude is higher.

However, the conventional step-up circuit 100 is still limited by the hardware. For example, the conventional step-up circuit 100 generates a plurality of groups of power supply voltages by the parallel connection cooperation of a plurality of resistances with various resistance values. But if the user needs further more groups of power supply voltages, the conventional step-up circuit 100 has to be cooperated with more resistances, and then the circuit will become further more complex and further huger.

In addition, FIG. 2B is a diagram showing errors of power supply voltages of the conventional step-up circuit 100. As shown in FIG. 2B, voltage errors formed by the power supply voltages are different when the conventional step-up circuit 100 works under different step-up orders. Herein, the voltage errors formed by the power supply voltages become larger along with the increment of the step-up order. The main reason is that the resistance value of the resistances R11~R14 which are parallelly connected is not linearly decreased, and then the error of the power supply voltage is increased along the increment of the step-up order.

BRIEF SUMMARY OF THE INVENTION

The invention provides a controllable power supply device with a step-up function, which not only simplify the hardware design of the conventional step-up circuit but also can provide a user with various power supply voltages.

The invention provides a controllable power supply device with a step-up function for simplifying the hardware design of the conventional step-up circuit and for effectively improving the accuracy of a power supply voltage.

The invention provides a controllable power supply device with a step-up function, and the controllable power supply device with the step-up function includes a constant voltage generator, a programmable voltage generator, a first switch and a linear regulator. The constant voltage generator is used for providing an initial voltage. The programmable voltage generator is coupled to the constant voltage generator to receive the initial voltage and adjust the received initial voltage to boost the received initial voltage to the power supply voltage. The first switch has a first connecting terminal, a second connecting terminal and a third connecting terminal, wherein the first connecting terminal receives the initial voltage, the second connecting terminal receives the power supply voltage, and the third connecting terminal is coupled to one of the first connecting terminal and the second connecting terminal. The linear regulator has an input terminal, wherein when the input terminal is coupled to the third connecting terminal of the first switch, the voltage received by the input terminal of the linear regulator is stabilized and outputted as the output voltage of the controllable power supply device by the linear regulator.

From another point of view, the invention provides a controllable power supply device with a step-up function, and the controllable power supply device with the step-up function includes a constant voltage generator, a signal generator, a programmable voltage generator, a first switch and a linear regulator. The constant voltage generator is used to provide an initial voltage. The signal generator generates a power supply control signal and a first switch signal. The programmable voltage generator is coupled to the constant voltage generator and is used for receiving the initial voltage and adjusting the received initial voltage to boost the received initial voltage to the power supply voltage.

The first switch has a first connecting terminal, a second connecting terminal and a third connecting terminal, wherein the first connecting terminal receives the initial voltage, the second connecting terminal receives the power supply voltage, and the third connecting terminal is coupled to one of the first connecting terminal and the second connecting terminal. The linear regulator has an input terminal, wherein when the input terminal is coupled to the third connecting terminal of the first switch, the voltage received by the input terminal of the linear regulator is stabilized and outputted as the output voltage of the controllable power supply device by the linear regulator.

The invention utilizes the programmable voltage generator to adjust and control power supply voltages expected by users without utilizing a parallel connection combination formed by resistances, and therefore, the invention not only can simplify the hardware design of the conventional step-up circuit but also can effectively improve the accuracy of a power supply voltage.

These and other features, aspects, and advantages of the present invention will become better understood with regard to the following description, appended claims, and accompanying drawings.

DETAILED DESCRIPTION OF THE EMBODIMENTS

Figure 1:
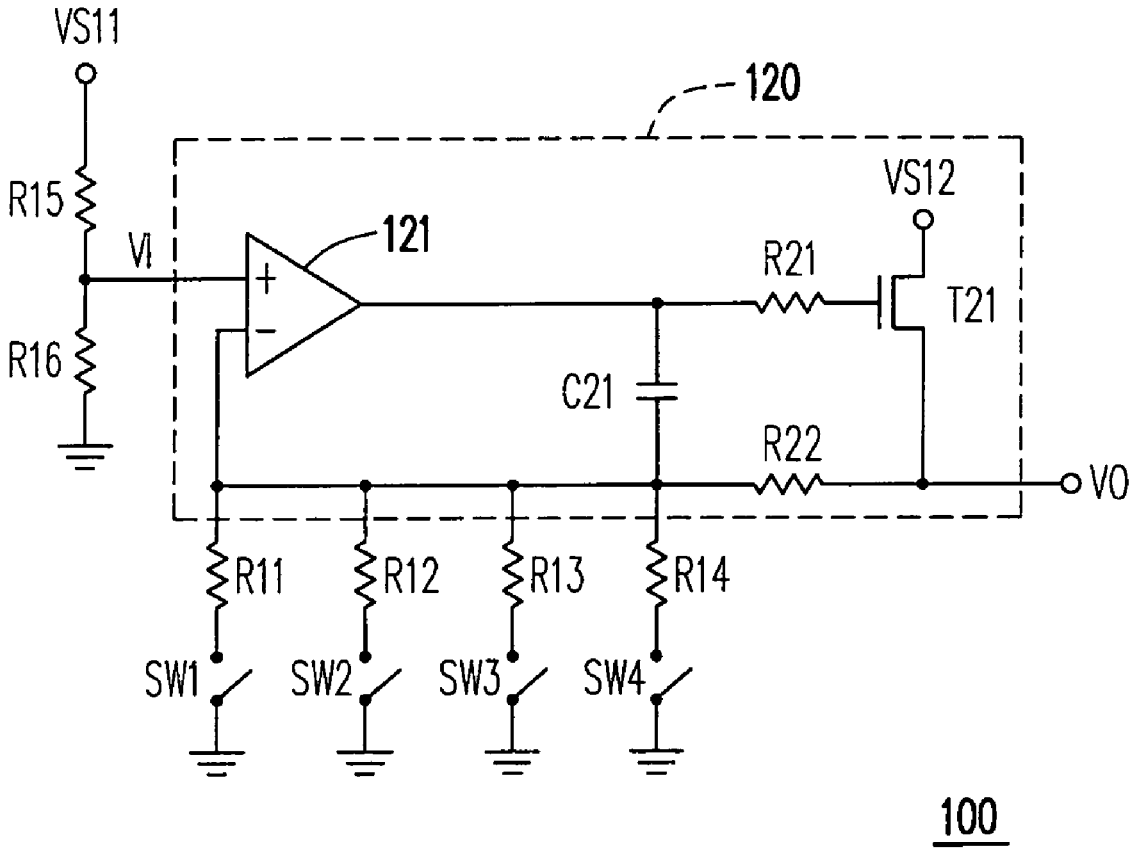
FIG. 1 (PRIOR ART)
FIG. 1 is a structural diagram showing a conventional step-up circuit 100.
Figures 2A, 2B:
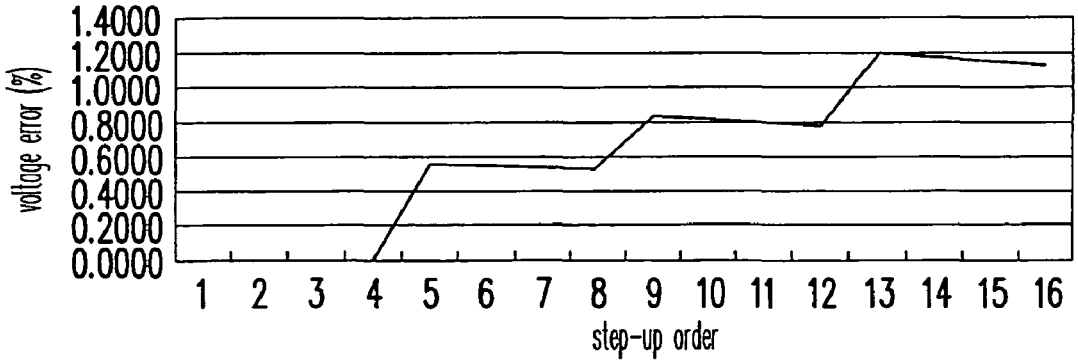
FIG. 2A (PRIOR ART)
FIG. 2B (PRIOR ART)
FIG. 2A is a schematic diagram showing the step-up table of the power supply voltage of the conventional step-up circuit 100.
FIG. 2B is a diagram showing errors of power supply voltages of the conventional step-up circuit 100.
Figure 3A:
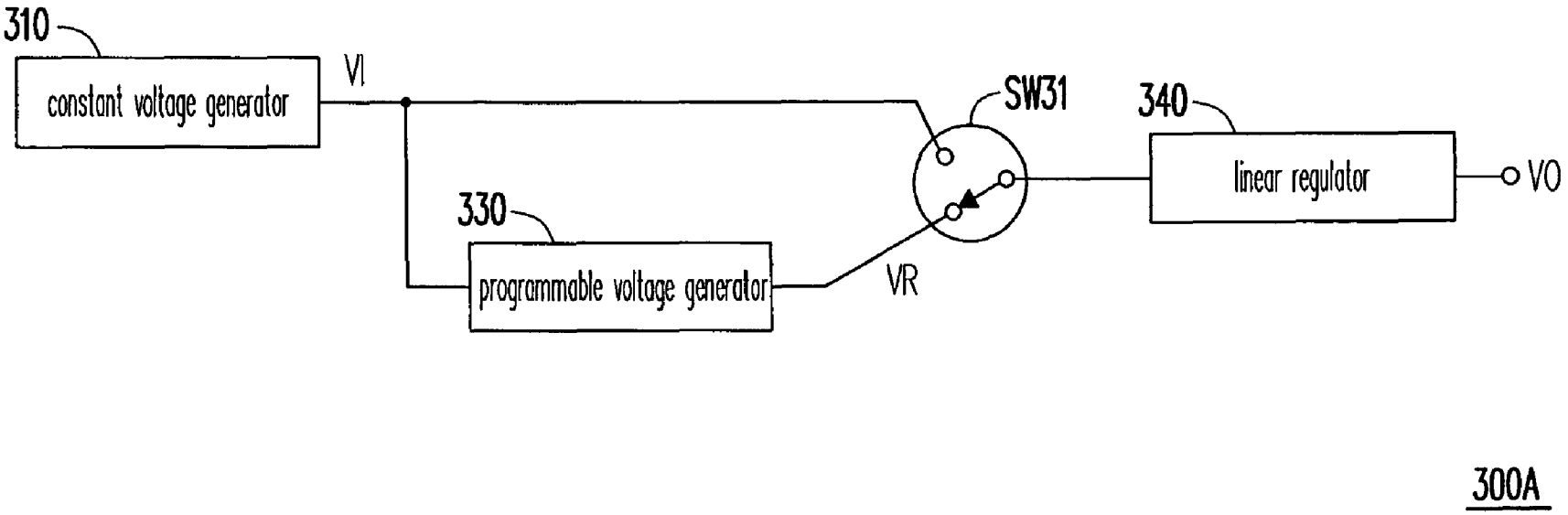
FIG. 3A is a schematic diagram showing the circuit of a controllable power supply device with a step-up function 300A according to one embodiment of the invention.

FIG. 3A is a schematic diagram showing the circuit of a controllable power supply device with a step-up function 300A according to one embodiment of the invention. Please refer to FIG. 3A, and the controllable power supply device with the step-up function 300A includes a constant voltage generator 310, a programmable voltage generator 330, a linear regulator 340 and a switch SW31. The constant voltage generator 310 is coupled to the programmable voltage generator 330 and the switch SW31. The switch SW31 has a first connecting terminal, a second connecting terminal and a third connecting terminal, wherein the first connecting terminal is coupled to the constant voltage generator 310, the second connecting terminal is coupled to the programmable voltage generator 330, and the third connecting terminal is coupled to the linear regulator 340.

Now, FIG. 3A is taken to illustrate the working principle of the controllable power supply device with a step-up function 300A. First, the constant voltage generator 310 provides an initial voltage VI and transmits the initial voltage VI to the programmable voltage generator 330. The programmable voltage generator 330 is used to receive the initial voltage VI and adjust the received initial voltage VI to boost the received initial voltage VI to the power supply voltage VR. And then, the first connecting terminal of the switch SW31 is used to receive the initial voltage VI, and the second connecting terminal of the switch SW31 is used to receive the power supply voltage VR. In addition, the third connecting terminal of the switch SW31 is coupled to the first connecting terminal or the second connecting terminal to enable the initial voltage VI or the power supply voltage VR to be transmitted to the linear regulator 340. Finally, the linear regulator 340 can receive the voltage transmitted from the switch SW31 and stably output the voltage as the output voltage VO of the controllable power supply device 300A.

Figure 3B:
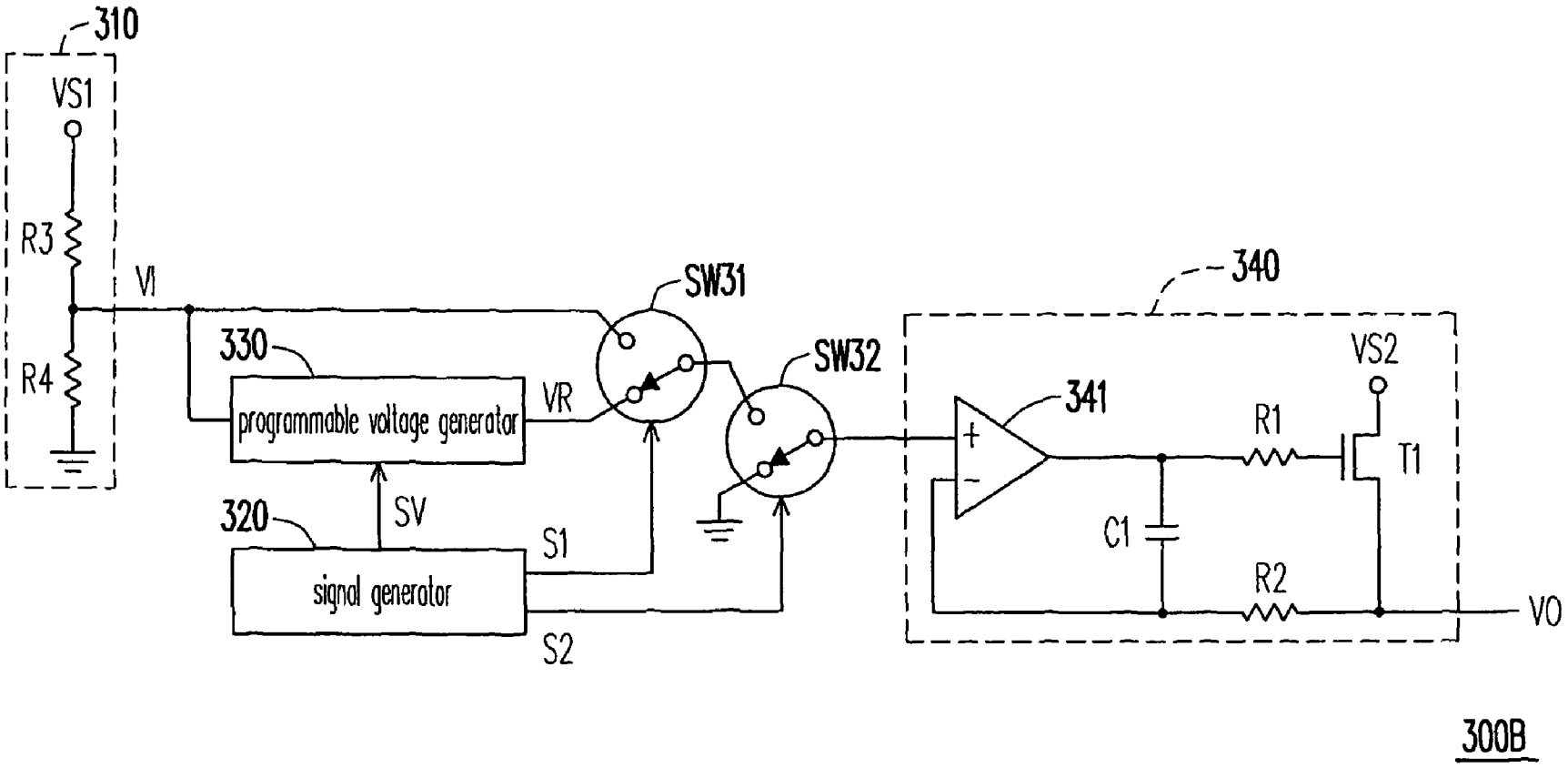
FIG. 3B is a schematic diagram showing the circuit of a controllable power supply device with a step-up function 300B according to another embodiment of the invention.

FIG. 3B is a schematic diagram showing the circuit of a controllable power supply device with a step-up function 300B according to another embodiment of the invention. Please refer to FIG. 3B, the controllable power supply device with the step-up function 300B includes a constant voltage generator 310, a signal generator 320, a programmable voltage generator 330, a switch SW31, a switch SW32 and a linear regulator 340. The constant voltage generator 310 is used to provide an initial voltage VI. The signal generator 320 is coupled to the programmable voltage generator 330, the switch SW31 and the switch SW32 to generate a power supply control signal SV, a switch signal S1 and a switch signal S2. The programmable voltage generator 330 is coupled to the constant voltage generator 310 and the switch SW31 to receive the initial voltage VI, and adjust and control the received initial voltage VI according to the power control signal SV to boost the received initial voltage VI to the power supply voltage VR.

The switch SW31 has a first connecting terminal, a second connecting terminal and a third connecting terminal, wherein the first connecting terminal of the switch SW31 is used to receive the initial voltage VI, and the second connecting terminal is coupled to the programmable voltage generator 330. The switch SW32 has a first connecting terminal (which can be regarded as the fourth connecting terminal), a second connecting terminal (which can be regarded as the fifth connecting terminal) and the third connecting terminal (which can be regarded as the sixth connecting terminal), wherein the first connecting terminal (which can be regarded as the fourth connecting terminal) of the switch SW32 is coupled to the third connecting terminal of the switch SW31, the second connecting terminal (which can be regarded as the fifth connecting terminal) of the switch SW32 is coupled to the grounding terminal, and the third connecting terminal (which can be regarded as the sixth connecting terminal) of the switch SW32 is coupled to the input terminal of the linear regulator 340. In addition, the third connecting terminal of the switch SW31 is coupled to the first connecting terminal or the second connecting terminal of the switch SW31 according to the switch signal S1. Similarly, the third connecting terminal (which can be regarded as the sixth connecting terminal) of the switch SW32 is also coupled to the first connecting terminal (which can be regarded as the fourth connecting terminal) of the switch SW32 or the second connecting terminal (which can regarded as the fifth connecting terminal) of the switch SW32 according to the switch signal S2.

On the other hand, the linear regulator 340 has an input terminal, and when the input terminal of the linear regulator 340 is coupled to the third connecting terminal of the switch SW31 via the switch SW32, the linear regulator 340 is used to stabilize and output the voltage (the initial voltage VI or the power supply voltage VR) received by the input terminal of the linear regulator 340 to be the output voltage of the controllable power supply device 300B.

Furthermore, the constant voltage generator 310 includes resistances R3 and R4. The resistance R3 has a first terminal and a second terminal, wherein the first terminal of the resistance R3 is used to receive the first voltage VS1, and the second terminal of the resistance R3 is used to output the initial voltage VI. The resistance R4 has a first terminal and a second terminal, wherein the first terminal (which can be regarded as the third terminal) of the resistance R4 is coupled to the second terminal of the resistance R3, and the second terminal (which can be regarded as the fourth terminal) of the resistance R4 is coupled to the grounding terminal.

In addition, the linear regulator 340 includes an operation amplifier 341, an N-type transistor T1, a capacitor C1 and resistances R1~R2. The positive input terminal of the operation amplifier 341 is coupled to the input terminal of the linear regulator 340, and the negative input terminal of the operation amplifier 341 is coupled to the output terminal of the operation amplifier 341 via the capacitor C1. The resistance R1 has a first terminal (which can be regarded as the fifth terminal) and a second terminal (which can be regarded as the sixth terminal), and the first terminal (which can be regarded as the fifth terminal) of the resistance R1 is coupled to the first terminal of the capacitor C1, and the second terminal of the resistance R1 is coupled to the grid electrode terminal of the N-type transistor T1. The resistance R2 has a first terminal and a second terminal, and the first terminal of the resistance R2 is coupled to the second terminal of the capacitor C1, and the second terminal of the resistance R2 is coupled to the source electrode terminal of the N-type transistor T1. The drain electrode terminal of the N-type transistor T1 is used to receive a second voltage VS2, and the source electrode terminal is used to provide the output voltage VO.

Please refer to FIG. 3B, and the following illustrates the working principle of the controllable power supply device 300B in detail. When the programmable voltage generator 330 is started, firstly, the constant voltage generator 310 utilizes the resistances R3 and R4 to divide the first voltage VS1, and then the initial voltage VI is generated and outputted. The constant voltage generator 310 outputs the initial voltage VI to the programmable voltage generator 330 and the switch SW31. And then, the signal generator 320 can provide the switch signals S1 and S2 which are transmitted to the switches SW31 and SW32, respectively. At this time, the switch SW31 receives the switch signal S1 and makes the first connecting terminal and the third connecting terminal of the switch SW31 conduct according to the switch signal S1 to make the initial voltage VI transmitted to the third connecting terminal of the switch SW31. In addition, the switch SW32 receives the switch signal S2 and makes the first connecting terminal (which can be regarded as the fourth terminal) and the third connecting terminal (which can regarded as the sixth connecting terminal) of the SW32 conduct according to the switch signal S2 to make the initial voltage VI received by the first connecting terminal (which can be regarded as the fourth terminal) of the SW32 transmitted to the linear regulator 340 via the third connecting terminal (which can be regarded as the sixth connecting terminal) of the SW32, and then the linear regulator 340 can receive the initial voltage VI. And then, the controllable power supply device 300B outputs a stable output voltage VO via the voltage-stabilizing function of the linear regulator 340, and the value of the output voltage VO is equal to the value of the initial voltage VI.

After the system is started, the controllable power supply device 300B can also perform the step-up action according to the power control signal SV and the switch signals S1~S2. For example, when the signal generator generates the power control signal SV, the programmable voltage generator 330 adjusts the initial voltage VI according to the power control signal SV to boost the initial voltage VI to the power supply voltage VR. Next, the signal generator 320 can generate the switch signals S1 and S2 to enable the switch SW31 to make the second connecting terminal and the third connecting terminal conduct and to enable the SW32 to make the first connecting terminal (which can be regarded as the fourth connecting terminal) and the third connecting terminal (which can be regarded as the sixth connecting terminal) conduct. Under the control of the switches S1 and S2, the linear regulator 340 can receive the power supply voltage VR. Therefore, the controllable power supply device 300B outputs a stable output voltage VO via the voltage-stabilizing function of the linear regulator 340 and the value of the output voltage VO is equal to the value of the power supply voltage VR.

In addition, the working principle of the linear regulator 340 in the above embodiment is that the initial voltage VI or the power supply voltage VR is received via the positive input terminal of the operation amplifier 341, and then the output terminal of the operation amplifier 341 can provide a voltage to the grid electrode terminal of the N-type transistor T1. And then, the grid electrode terminal of the N-type transistor T1 can determine the operation state of the N-type transistor T1 according to the voltage. Finally, the linear regulator 340 utilizes a negative feedback circuit configuration formed by the resistances R1 and R2, the capacitor C1 and the N-type transistor T1 to enable the output terminal of the linear regulator 340 to provide the stable output voltage VO.

Furthermore, the programmable voltage generator 330 further includes a digital-to-analog converter. The digital-to-analog converter selects one from a plurality of groups of reference voltages as the output voltage according to the received power supply control signal SV. And then, the programmable voltage generator 330 adds the received initial voltage VI to the output voltage of the digital-to-analog converter to obtain the power supply voltage VR. Therefore, the programmable voltage generator 330 can boost the received initial voltage VI to the power supply voltage VR according to the power control signal SV.

The signal generator 320 can transmit the power supply control signal SV to the programmable voltage generator 330 via an inter-integrated circuit (I2C) bus. Similarly, the signal generator 320 can also transmit the switch signals S1~S2 to the switches SW31~SW32 via the I2C bus. In other words, the power supply control signal SV and the switch signals S1~S2 can be I2C instructions, respectively. In addition, the signal generator 320 can be replaced from the controllable power supply device 300B to enable the controllable power supply device 300B to generate the initial voltage VI or the power supply voltage VR according to an external control signal.

In addition, the controllable power supply device 300B utilizes the signal generator 320 to generate the power supply control signal SV to the programmable voltage generator 330 to instruct the programmable voltage generator 330 to generate the power supply voltage VR expected by a user. Therefore, the controllable power supply device 300B can provide the power supply voltage VR which is more accurate than the power supply voltage provided by the conventional step-up circuit 100, and the condition that the power supply voltage error becomes larger because resistances are parallelly connected does not occur.

To sum up, the invention utilizes a programmable voltage generator to generate a power supply voltage expected by a user without a parallel connection combination which is formed by resistances, and therefore, the error of the power supply voltage will not become larger because of the step-up order. In addition, since the parallel connection combination which is formed by the resistances is not utilized, the invention can further simplify the hardware design of the circuit.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A controllable power supply device with a step-up function, the controllable power supply device comprising:

a constant voltage generator for providing, an initial voltage;

a programmable voltage generator which is coupled to the constant voltage generator and is used for receiving the initial voltage and adjusting the received initial voltage to boost the received initial voltage to a power supply voltage;

a first switch having a first connecting terminal, a second connecting terminal and a third connecting terminal, wherein the first connecting terminal is used for receiving the initial voltage, the second connecting terminal is used for receiving the power supply voltage, and the third connecting terminal is coupled to one of the first connecting terminal and the second connecting terminal; and a linear regulator having an input terminal, wherein when the input terminal is coupled to the third connecting terminal, the voltage received by the input terminal of the linear regulator is stabilized and outputted as the output voltage of the controllable power supply device by the linear regulator.

2. The controllable power supply device with the step-up function according to claim 1 further comprising a second switch which has a fourth connecting terminal coupled to the third connecting terminal, a fifth connecting terminal coupled to a grounding terminal, and a sixth connecting terminal coupled to the input terminal of the linear regulator, wherein the sixth connecting terminal is coupled to one of the first connecting terminal and the second connecting terminal.

3. The controllable power supply device with the step-up function according to claim 2 further comprising a signal generator for generating a control signal which is needed to switch the first switch and the second switch.

4. The controllable power supply device with the step-up function according to claim 1, wherein the constant voltage generator comprises:

a first resistance having a first terminal and a second terminal, wherein the first terminal is coupled to a first voltage, and the second terminal is used for providing the initial voltage; and a second resistance having a third terminal and a fourth terminal, wherein the third terminal is coupled to the second terminal, and the fourth terminal is coupled to a grounding terminal.

5. The controllable power supply device with the step-up function according to claim 1, wherein the linear regulator comprises:

an operation amplifier having a positive input terminal, a negative input terminal and an output terminal, wherein the positive input terminal is coupled to the input terminal of the linear regulator;

a capacitor, wherein the first terminal of the capacitor is coupled to the output terminal of the operation amplifier, and the second terminal of the capacitor is coupled to the negative input terminal of the operation amplifier;

a third resistance having a fifth terminal and a sixth terminal, wherein the fifth terminal is coupled to the first terminal of the capacitor;

a fourth resistance having a seventh terminal and an eighth terminal, wherein the seventh terminal is coupled to the second terminal of the capacitor; and an N-type transistor, wherein the drain electrode terminal of the N-type transistor is used for receiving a second voltage, the grid electrode terminal of the N-type transistor is coupled to the sixth terminal, and the source electrode terminal of the N-type transistor is coupled to the eighth terminal and is used for providing the output voltage of the controllable power supply device.

6. A controllable power supply device with a step-up function, the controllable power supply device comprising:

a constant voltage generator for providing an initial voltage;

a signal generator for generating a power control signal and a first switch signal;

a programmable voltage generator which is coupled to the constant voltage generator and is used for receiving the initial voltage and adjusting and controlling the received initial voltage according to the power control signal to boost the received initial voltage to a power supply voltage;

a first switch having a first connecting terminal, a second connecting terminal and a third connecting terminal, wherein the first connecting terminal is used for receiving the initial voltage, the second connecting terminal is used for receiving the power supply voltage, and the third connecting terminal is coupled to the first connecting terminal or the second connecting terminal according to the first switch signal; and a linear regulator having an input terminal, wherein when the input terminal is coupled to the third connecting terminal, the voltage received by the input terminal of the linear regulator is stabilized and outputted as the output voltage of the controllable power supply device by the linear regulator.

7. The controllable power supply device with the step-up function according to claim 6 further comprising a second switch having a fourth connecting terminal, a fifth connecting terminal and a sixth connecting terminal, wherein the fourth connecting terminal is coupled to the third connecting terminal, the fifth connecting terminal is coupled to a grounding terminal, and the sixth connecting terminal is coupled to the input terminal of the linear regulator and is coupled to the fourth connecting terminal or the fifth connecting terminal according to a second switch signal which is provided by the signal generator.

8. The controllable power supply device with the step-up function according to claim 7, wherein the constant voltage generator comprises:

a first resistance having a first terminal and a second terminal, wherein the first terminal is coupled to a first voltage, and the second terminal is used for providing the initial voltage; and a second resistance having a third terminal and a fourth terminal, wherein the third terminal is coupled to the second terminal, and the fourth terminal is coupled to the grounding terminal.

9. The controllable power supply device with the step-up function according to claim 7, wherein the linear regulator comprises:

an operation amplifier having a positive input terminal, a negative input terminal and an output terminal, wherein the positive input terminal is coupled to the input terminal of the linear regulator;

a capacitor, wherein the first terminal of the capacitor is coupled to the output terminal of the operation amplifier, and the second terminal of the capacitor is coupled to the negative input terminal of the operation amplifier;

a third resistance having a fifth terminal and a sixth terminal, wherein the fifth terminal is coupled to the first terminal of the capacitor;

a fourth resistance having a seventh terminal and an eighth terminal, wherein the seventh terminal is coupled to the second terminal of the capacitor; and an N-type transistor, wherein the drain electrode terminal of the N-type transistor is used for receiving a second voltage, the grid electrode terminal of the N-type transistor is coupled to the sixth terminal, and the source electrode terminal of the N-type transistor is coupled to the eighth terminal and is used for providing the output voltage of the controllable power supply device.

* * * * *